US008574491B2

(12) United States Patent
Donati

(10) Patent No.: US 8,574,491 B2
(45) Date of Patent: Nov. 5, 2013

(54) UNIT AND METHOD FOR STERILIZING A WEB OF PACKAGING MATERIAL FOR A MACHINE FOR PACKAGING POURABLE FOOD PRODUCTS

(75) Inventor: Andrea Donati, Castelnuovo (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 281 days.

(21) Appl. No.: 12/988,217

(22) PCT Filed: May 14, 2009

(86) PCT No.: PCT/EP2009/055886

§ 371 (c)(1),
(2), (4) Date: Oct. 15, 2010

(87) PCT Pub. No.: WO2009/138481

PCT Pub. Date: Nov. 19, 2009

(65) Prior Publication Data

US 2011/0038756 A1 Feb. 17, 2011

(30) Foreign Application Priority Data

May 15, 2008 (EP) ..... 08156318

(51) Int. Cl.
*A61L 2/00* (2006.01)
*A61L 2/18* (2006.01)
*A61L 9/00* (2006.01)

(52) U.S. Cl.
USPC ..... 422/28; 422/31; 422/292; 422/300; 422/302; 422/304

(58) Field of Classification Search
USPC ..... 422/28, 31, 292, 300, 301, 302, 304
See application file for complete search history.

(56) References Cited

U.S. PATENT DOCUMENTS 2,733,150 A * 1/1956 Mulvany ..... 426/231
4,411,930 A * 10/1983 Nakazima et al. ..... 427/508

(Continued)

FOREIGN PATENT DOCUMENTS

EP 0 968 923 A 1/2000
EP 1 334 912 A 8/2003
EP 1 795 448 A 6/2007

OTHER PUBLICATIONS

International Search Report (PCT/ISA/210) issued on Sep. 1, 2009, by European Patent Office as the International Searching Authority for International Application No. PCT/EP2009/055886.

(Continued)

*Primary Examiner* — Regina M Yoo
(74) *Attorney, Agent, or Firm* — Buchanan Ingersoll & Rooney PC

(57) ABSTRACT

A unit for sterilizing a web of packaging material for a machine for packaging pourable food products includes a sterilizing chamber containing a liquid sterilizing agent at a first temperature; a conveying device for feeding the web through the sterilizing chamber before the web is formed into a succession of sealed packages of pourable food products; a hold tank for the sterilizing agent; a feed mechanism activated selectively to feed the sterilizing agent from the tank to the sterilizing chamber; a drain activated selectively to drain the sterilizing agent from the sterilizing chamber into the tank in the event of stoppage of the packaging machine; and a cooling device activated selectively, at the end of the package production cycle, to cool the sterilizing agent in the tank to a second temperature lower than the first temperature.

18 Claims, 2 Drawing Sheets

(56) References Cited

U.S. PATENT DOCUMENTS

| | | | | |
|---|---|---|---|---|
| 4,764,351 | A * | 8/1988 | Hennebert et al. | 422/292 |
| 5,245,845 | A * | 9/1993 | Langford | 68/3 SS |
| 5,749,203 | A * | 5/1998 | McGowan, Jr. | 53/432 |
| 6,622,457 | B2 * | 9/2003 | Kurth | 53/425 |
| 6,638,476 | B1 | 10/2003 | Elias et al. | |
| 7,871,016 | B2 * | 1/2011 | Ricciardi et al. | 239/102.2 |
| 2005/0076612 | A1 | 4/2005 | Andersson et al. | |

OTHER PUBLICATIONS

Written Opinion (PCT/ISA/237) issued on Sep. 1, 2009, by European Patent Office as the International Searching Authority for International Application No. PCT/EP2009/055886.

* cited by examiner 7
6
2
9b
9a
48
40
41
42
47
47
49
1
4
31
24
30
26
21
5
25
3
22
P
27
23
20
38
32
35
19
29
28
36
37
33
10
9c
34
16
8
12
15
18
17
14
43
63
50
44
45
46
58
55
61
11
13
62
56
53
54
51
52
57
59
60

UNIT AND METHOD FOR STERILIZING A WEB OF PACKAGING MATERIAL FOR A MACHINE FOR PACKAGING POURABLE FOOD PRODUCTS

TECHNICAL FIELD

The present invention relates to a unit and method for sterilizing a web of packaging material for a machine for packaging pourable food products.

BACKGROUND ART

As is known, many food products, such as fruit juice, UHT milk, wine, tomato sauce, etc., are sold in packages made of sterilized sheet packaging material.

A typical example of this type of package is the parallelepiped-shaped package for liquid or pourable food products known as Tetra Brik Aseptic (registered trademark), which is made by folding and sealing laminated strip packaging material.

The packaging material has a multilayer structure substantially comprising a base layer for stiffness and strength, which may be defined by a layer of fibrous material, e.g. paper; and a number of layers of heat-seal plastic material, e.g. polyethylene film, covering both sides of the base layer.

In the case of aseptic packages for long-storage products, such as UHT milk, the packaging material also comprises a layer of gas- and light-barrier material, e.g. aluminium foil or ethyl vinyl alcohol (EVOH) film, which is superimposed on a layer of heat-seal plastic material, and is in turn covered with another layer of heat-seal plastic material forming the inner face of the package eventually contacting the food product.

As is known, packages of this sort are produced on fully automatic packaging machines, on which a continuous tube is formed from the web-fed packaging material. The web of packaging material is unwound off a reel and fed through a sterilizing unit, where it is sterilized, e.g. by immersion in a chamber of liquid sterilizing agent, such as a concentrated solution of hydrogen peroxide and water.

The web is then fed into an aseptic chamber where the sterilizing agent is evaporated by heating. The web is then folded into a cylinder and sealed longitudinally to form in known manner a continuous vertical tube, which in effect forms an extension of the aseptic chamber. The tube of packaging material is filled continuously with the pourable food product and then fed to a form-and-seal unit, where it is gripped between pairs of jaws which seal the tube transversely to form pillow packs. The pillow packs are then separated from one another by cutting the seal joining each two adjacent packs, and are conveyed to a final folding station where they are folded mechanically into the finished shape.

More specifically, the sterilizing unit comprises a chamber containing the sterilizing agent, and into which the web is fed continuously. The sterilizing chamber conveniently comprises two parallel vertical branches connected at the bottom to define a U-shaped path long enough with respect to the travelling speed of the web to allow enough time to treat the packaging material.

For effective, relatively fast treatment, e.g. in about 7 seconds, to reduce the size of the sterilizing chamber, the sterilizing agent must be maintained at a high temperature, e.g. of around 73° C. In known sterilizing units, this can be done, for example, by fitting electric heaters to the walls of the vertical branches of the sterilizing chamber.

Being covered with a layer of heat-seal plastic material, normally polyethylene, the faces of the web of packaging material are completely impermeable to the sterilizing agent. Along the edges of the web, however, the layer of fibrous material is exposed, and tends to soak up the sterilizing agent. This is known in the trade as "edge wicking", and remains within acceptable limits providing the web is only kept for a short time inside the sterilizing chamber, as is the case during normal operation of the machine.

If for any reason the machine is stopped, however, the sterilizing chamber must be emptied immediately. Otherwise, the edges of the layer of fibrous material soak up the sterilizing agent, and edge wicking of a few millimetres in width inevitably impairs subsequent longitudinal sealing of the web to form the tube of packaging material as described above.

In other words, in the event the machine is stopped, the sterilizing agent is drained rapidly into a normally double-walled hold tank. The inner walls define an inner shell of the tank containing the sterilizing agent; and the outer walls form an outer shell of the tank defining, with the inner shell, a normally air-filled gap which provides for thermally insulating the sterilizing agent.

In known machines, in the event of a short stoppage, normally of no more than 15-20 minutes, and particularly when starting up the machine again, edge wicking tends to occur anyway, despite emptying the sterilizing chamber.

Careful study of the phenomenon has identified several causes, foremost of which are:

- the porosity of the fibrous material, which, however, can only be reduced so far for paper manufacturing cost reasons;
- hydrostatic pressure, which is also difficult to reduce, on account of the height of the U-shaped sterilizing chamber depending on the necessary processing time, and only being reducible by altering the architecture of the sterilizing unit, thus complicating the system as a whole; and
- the temperature of the sterilizing chamber during the stoppage, and of the sterilizing agent when fed back into the chamber.

As regards the latter, in particular, a difference of even only a few degrees between the temperature of the chamber during the stoppage and the temperature of the sterilizing agent fed back into the chamber has been found to produce severe edge wicking. In conventional machines, this difference in temperature is caused by the tendency of the emptied sterilizing chamber to increase in temperature, on account of the inevitable delay in response of the thermostatic control to the reduction in heat absorption caused by emptying the chamber: the temperature inside the chamber is therefore normally around at least 80° C. As a result, the residual sterilizing agent on the walls of the chamber and in the packaging material tends to evaporate, thus producing a saturated-vapour condition of the chamber, so that the pores of the layer of fibrous material contain a saturated air/vapour mixture.

When liquid sterilizing agent is fed into the chamber, at a temperature inevitably lower than that inside the sterilizing chamber, the temperature of the web, and therefore of the air/vapour mixture in the pores, is reduced. This reduction has a practically negligible effect on the air, which undergoes a contraction in volume of only a few percent, but has a very serious effect on the vapour, which recondenses and so assumes a much smaller volume in the liquid state. This drastic reduction in volume has the effect of "sucking" the sterilizing agent into the pores of the fibrous material layer, which is the major cause of edge wicking.

By way of a solution to the problem, sterilizing units have been devised, in which the sterilizing agent is heated before being fed into the sterilizing chamber.

In the case of prolonged stoppages, as, for example, at the end of the package production cycle, simply draining the sterilizing agent into the hold tank is sufficient to prevent edge wicking, even when the packaging machine is started up again. During a prolonged stoppage, in fact, the residual liquid inside the sterilizing chamber evaporates, and relative humidity inside the chamber is reduced. When the packaging machine is started up again after an end-of-cycle shutdown, the sterilizing chamber and the packaging material inside it are perfectly dry.

In known sterilizing units of the above type, the sterilizing chamber and other sterile parts of the packaging machine are ventilated at the end of each production cycle to remove any residual sterilizing agent, by blowing in air, which is then sprayed with water to eliminate the residual sterilizing agent.

Packaging machines of the above type are used widely and satisfactorily in a wide range of food industries; and performance of the sterilizing unit, in particular, is such as to ensure a wide margin of safety as regards regulations governing aseptic packages and the permitted amount of residual sterilizing agent.

A need is felt within the industry, however, for further improvement, particularly as regards the average "life" of the sterilizing agent, i.e. the average length of time the sterilizing agent remains effective.

DISCLOSURE OF INVENTION

It is an object of the present invention to provide a sterilizing unit which provides, simply and cheaply, for increasing the average life of the sterilizing agent, as compared with that of the above known sterilizing units.

According to the present invention, there is provided a sterilizing unit, as claimed in Claim 1.

The present invention also relates to a sterilizing method, as claimed in Claim 9.

BRIEF DESCRIPTION OF THE DRAWINGS

Two preferred, non-limiting embodiments of the present invention will be described by way of example with reference to the accompanying drawings, in which.

BEST MODE FOR CARRYING OUT THE INVENTION

Figure 1:
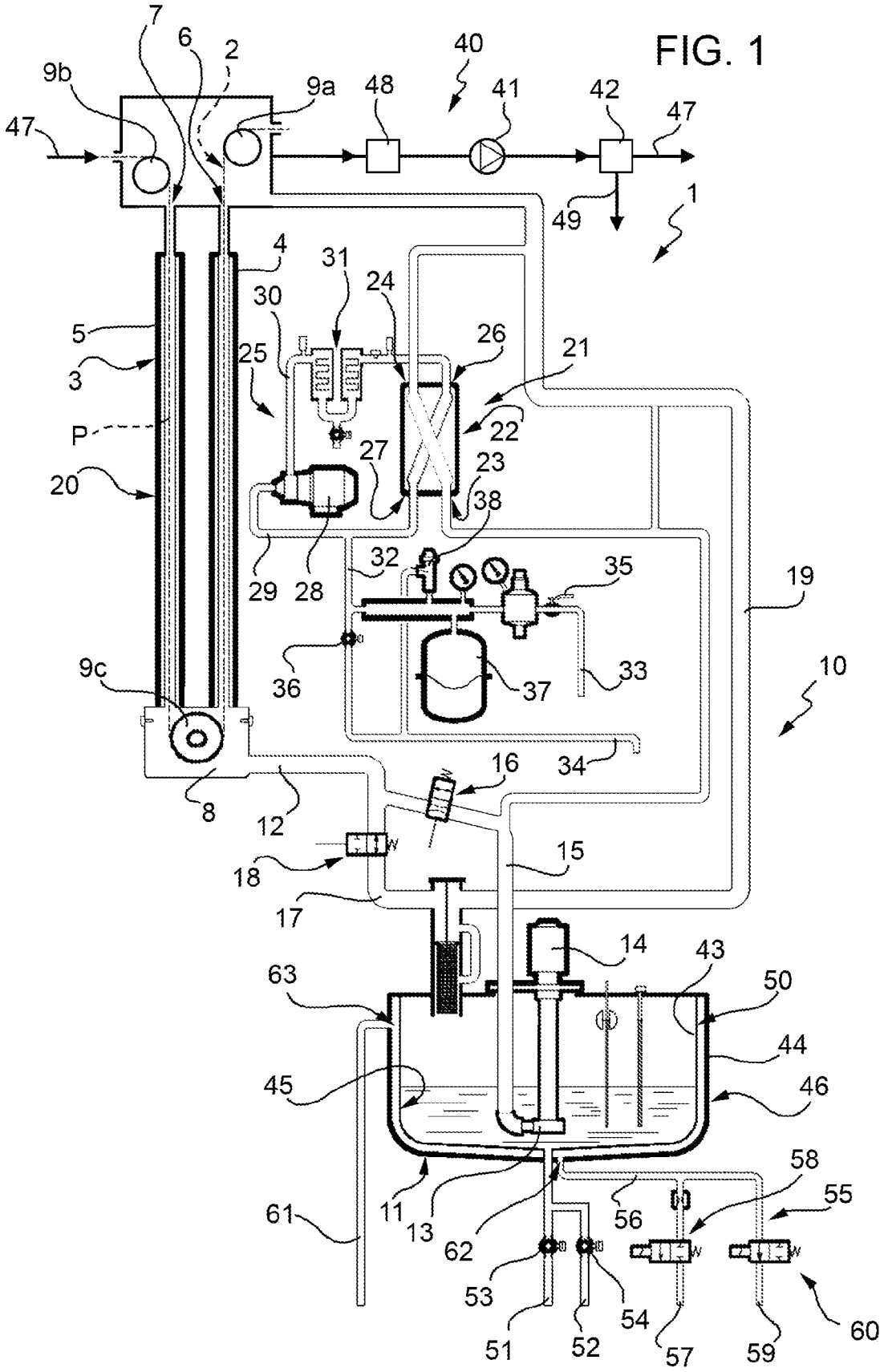
FIG. 1 shows a circuit diagram of a first embodiment of the invention.

Number 1 in FIG. 1 indicates as a whole a sterilizing unit for sterilizing a web 2 of packaging material for a packaging machine for packaging pourable food products and of the known type described above.

Web 2 is fed in known manner, not shown, to unit 1 off a reel, so as to be sterilized before being formed into a succession of sealed packages (not shown) of pourable food products. The form, fill, and seal operations performed in known manner on web 2 (as described above) downstream from unit 1 do not form part of the present invention, and are referred to here purely for the sake of clarity.

Web 2 has a multilayer structure and comprises a base layer for stiffness and strength, which may be made of fibrous material, e.g. paper; and a number of layers of heat-seal plastic material, e.g. polyethylene film, covering both sides of the base layer.

In the case of aseptic packages for long-storage products, such as UHT milk, web 2 also comprises a layer of gas-barrier material, e.g. aluminium foil or ethyl vinyl alcohol (EVOH) film, which is superimposed on a layer of heat-seal plastic material, and is in turn covered with another layer of heat-seal plastic material eventually contacting the food product.

With reference to FIG. 1, unit 1 substantially comprises a U-shaped sterilizing chamber or bath 3 containing a liquid sterilizing agent, e.g. a 30% solution of hydrogen peroxide ($H_2O_2$) and water, at a temperature $T_1$, e.g. ranging between 70° C. and 75° C. and preferably no less than 73° C. Chamber 3 is defined by two vertical, respectively inlet and outlet, conduits 4, 5 having respective top openings 6, 7 and connected to each other at the bottom by a bottom portion 8.

By way of example, FIG. 1 shows a number of horizontal rollers for guiding web 2 through conduits 4, and bottom portion 8 of chamber 3, and more specifically: an input roller 9*a* close to top opening 6 of conduit 4; an output roller 9*b* close to top opening 7 of conduit 5; and a return roller 9*c* housed inside bottom portion 8 of chamber 3.

Inside chamber 3, web 2 therefore describes a U-shaped path P, the length of which depends on the travelling speed of web 2, and is such as to keep the packaging material long enough inside the sterilizing agent.

Chamber 3 forms part of a sterilizing agent control circuit 10 also comprising:

- a sterilizing agent hold tank 11;
- a conduit 12 for filling/draining chamber 3;
- a pump 13 immersed in tank 11 and powered by an electric motor 14;
- a feed conduit 15 connecting pump 13 to conduit 12 via a valve 16; and
- a drain pipe 17 connecting conduit 12 to tank 11 via a valve 18.

Tank 11 provides for topping up chamber 3 to make up the loss in sterilizing agent caused by the wet out-going web 2, and for holding the sterilizing agent when draining chamber 3, e.g. in the event of any stoppage of the packaging machine.

Valve 16 is preferably a two-way, two-position, normally-open type, but with a flow on/off member (not shown) allowing leakage in the closed position to compensate, as stated, for inevitable sterilizing agent losses in chamber 3 during the production cycle. For this purpose, a commercial valve is sufficient, with a suitably sized hole formed in the on/off member.

Valve 18 is also preferably a two-way, two-position, normally-open type for safety reasons, to allow draining of chamber 3 in the event of a malfunction of the electric system.

Circuit 10 also comprises a recirculating conduit 19 connecting tank 11 to a known overflow (not shown) formed in the top of inlet conduit 4 of chamber 3 to determine the maximum sterilizing agent level in chamber 3.

Unit 1 also comprises a system 20 for controlling the temperature of the sterilizing agent in chamber 3. In the FIG. 1 embodiment, system 20 comprises a number of electric heaters fitted to the walls of conduits 4, 5 and shown schematically by the bold lines of the conduit walls.

Unit 1 also comprises a system 21 for preheating the sterilizing agent before it is fed into chamber 3.

System 21 substantially comprises a countercurrent heat exchanger 22 using water as the operating fluid. More specifically, heat exchanger 22 has a sterilizing agent inlet 23 connected to the feed conduit 15 of pump 13; a sterilizing agent outlet 24 connected to recirculating conduit 19; and a water phase series-connected to a heating circuit 25 and having an inlet 26 and an outlet 27.

Heating circuit 25 substantially comprises a circulating pump 28 having an intake conduit 29 connected to outlet 27 of heat exchanger 22, and a feed conduit 30 connected to an electric resistor heater 31 in turn connected at the output to inlet 26 of heat exchanger 22.

Intake conduit 29 of pump 28 is connected by a conduit 32 to a fill conduit 33 and a drain conduit 34, in turn connectable to the water mains by respective taps 35, 36. A water/compressed air tank 37, for compensating the pressure of heating circuit 25, and a maximum-pressure valve 38 are branch-connected in known manner to the fill conduit 33.

Unit 1 also comprises a known ventilation system 40 shown schematically in FIG. 1.

Ventilation system 40 is operated at the end of the package production cycle to blow air into sterilizing chamber 3 and the other sterile parts of the packaging machine, to remove residual sterilizing agent; and the airflow is then fed to a scrubber 48 which sprays it in known manner with water to eliminate the residual sterilizing agent.

Downstream from scrubber 48, ventilation system 40 comprises a compressor 41; and an air-water separator 42 for separating the water phase, which is drained off by a conduit 49. The air, on the other hand, is recovered (conduit 47), sterilized when the packaging machine is running, and fed back into unit 1.

As shown in FIG. 1, tank 11 is bounded laterally and at the bottom by double walls 43, 44; the inner walls (43) define an inner shell 45 of tank 11 containing the sterilizing agent; and the outer walls (44) form an outer shell 46 of tank 11, in turn defining, with inner shell 45, a normally air-filled gap 50 for thermally insulating the sterilizing agent.

Inner shell 45 of tank 11 is connected by respective taps 53, 54 to two different drain conduits 51, 52 for sampling and changing the sterilizing agent respectively.

Unit 1 advantageously also comprises a cooling system 55, which is activated selectively, at the end of the package production cycle and after the sterilizing agent is drained from chamber 3 to tank 11, to cool the sterilizing agent to a temperature $T_2$ lower than temperature $T_1$.

More specifically, temperature $T_2$ is selected to prevent degradation and destabilization of the sterilizing agent, and is preferably at least 15% lower than temperature $T_1$. More specifically, temperature $T_2$ is 60° C. or lower, and, in the example shown, is 58° C.

Cooling system 55 substantially comprises a conduit for filling/draining gap 50 of tank 11; a coolant feed conduit 57 connected to conduit 56 via a respective valve 58; a first drain conduit 59 also connected to conduit 56 via a respective valve 60; and a second drain conduit 61 communicating continuously with gap 50 of tank 11.

In the example shown, the coolant is water, and feed conduit 57 is connected to the water mains.

Valves 58, 60 are both two-way, two-position types; valve 58 is normally-closed, and valve 60 normally-open.

As shown in FIG. 1, fill/drain conduit 56 terminates inside gap 50 through an opening 62 formed in the bottom outer wall 44 of tank 11. Similarly, drain conduit 61 is connected to gap 50 via an opening 63 formed in a top portion of a lateral outer wall 44 of tank 11.

Opening 63 is preferably located above the maximum level of the sterilizing agent inside tank 11.

When valve 58 is opened and valve 60 closed, coolant flows continuously from feed conduit 57 to drain conduit 61 via gap 50, thus cooling the sterilizing agent in inner shell 45 of tank 11.

Coolant is drained from gap 50 by simply closing valve 58 and opening valve 60.

Unit 1 operates as follows.

When cold-starting, chamber 3 is empty, and all the sterilizing agent is inside inner shell 45 of tank 11; and gap 50 between inner shell 45 and outer shell 46 of tank 11 is full of air.

Pump 13 is turned on to pump a large amount of sterilizing agent, e.g. 50 l/min, through heat exchanger 22.

At this stage, valve 16 is closed, but, as stated, allows a small amount of leakage (a few litres/min) to conduit 12. Valve 18 is open, so chamber 3 is not filled until the best production cycle-start conditions are achieved. In the meantime, pump 28 circulates water through heater 31, and system 20 for controlling the temperature in chamber 3 is activated.

The cycle-start conditions are, for example, 72° C. for the heaters fixed to the walls of chamber 3, and 75° C. for the sterilizing agent in tank 11 (fill temperature). In which case, chamber 3 and web 2 being dry, there is practically no risk of edge wicking.

At the start of the cycle, valve 16 is opened, and valve 18 closed, so chamber 3 is filled rapidly with sterilizing agent; after which, valve 16 is closed.

The conduit 12, the pump 13, the feed conduit 15 and the valve 16 together form a feed means that is activated selectively by turning on the pump 13.

During normal operation of the packaging machine, the sterilizing agent is maintained at a minimum temperature of 73° C. in both chamber 3 and tank 11. If either one of these temperatures falls below the predetermined threshold value, a heating cycle is activated by means of the system 20 heaters and circuit 25 respectively.

Pump 13 is run continually to maintain a continuous flow through heat exchanger 22 (heater 31 on the other hand is normally turned off at this stage) and continuous leakage of conveniently a few litres/minute of sterilizing agent through valve 16, to compensate for the loss in sterilizing agent from chamber 3 caused, as stated, by the wet outgoing web 2, and to keep the bottom of chamber 3 and conduit 12 hot. Surplus sterilizing agent overflows from chamber 3, and flows along recirculating conduit 19 back into tank 11.

Pump 28 is also run continually; and the temperature of the sterilizing agent in chamber 3 is controlled in the normal way by the system 20 heaters, which are activated as soon as the temperature falls below the threshold value.

Heater 31 is activated if the temperature of the sterilizing agent in tank 11 falls below the threshold value.

In the event of stoppage of the packaging machine, valve 18 is opened immediately to drain the sterilizing agent rapidly from chamber 3 into tank 11.

The conduit 12, the drain pipe 17 and the valve 18 together form a draining means that is activated selectively by opening the valve 18.

In the event of a short stoppage of less than 15-20 minutes, chamber 3 is cooled to below operating temperature, and simultaneously the sterilizing agent is heated to the fill temperature (e.g. 75° C.).

Chamber 3 is cooled by turning off the system 20 heaters, and blowing in sterile air at a lower temperature than that of chamber 3.

The sterilizing agent is heated by activating heater 31.

The above conditions are achieved rapidly, normally in less than a minute, and ensure an acceptable degree of edge wicking at the next start-up. In fact, cooling chamber 3 and preheating the sterilizing agent to a higher temperature prevents condensation of the steam inside chamber 3 when chamber 3 is filled.

In the event of stoppage at the end of the package production cycle, ventilation system 40 is activated, after chamber 3 is drained, to ventilate chamber 3 and the other sterile parts of the packaging machine and remove any residual sterilizing agent; and the airflow is scrubbed by a jet of atomized water in known manner to eliminate the residual sterilizing agent.

Cooling system 55 is also activated simultaneously to cool the sterilizing agent in tank 11 to temperature $T_2$.

More specifically, valve 58 is opened, and valve 60 closed, so that coolant flows from feed conduit 57 to drain conduit 61 via gap 50, thus cooling the sterilizing agent in inner shell 45 of tank 11.

The cooling system 55 is a cooling means that is activated selectively by opening the valve 58.

Cooling normally lasts as long as the ventilation stage, roughly 10 minutes.

Once the sterilizing agent is cooled, valve 58 is closed, and valve 60 opened to drain the water from gap 50 of tank 11.

The Applicant has observed that end-of-cycle cooling provides for greatly reducing degradation and destabilization of the sterilizing agent, thus greatly prolonging its average working life.

Cooling the sterilizing agent at the end of the production cycle also prevents it from evaporating and so wetting parts of unit 1 and diluting the hydrogen peroxide concentration at the next sterilization stage.

These results are achieved using gap 50 of tank 11—which known units already feature for thermally insulating the sterilizing agent—and therefore with no need for additional heat exchangers. In other words, inclusion of the cooling stage calls for only minor alterations to known units.

Figure 2:
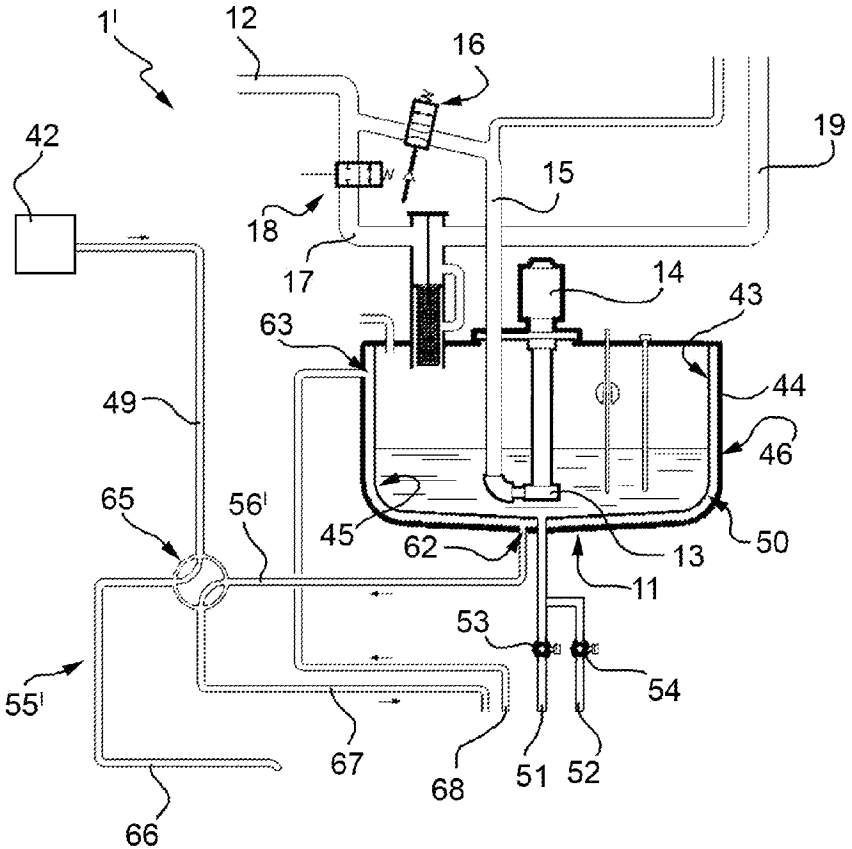
FIGS. 2 and 3 show partial circuit diagrams of a second embodiment of the invention in two different operating configurations.
Figure 3:
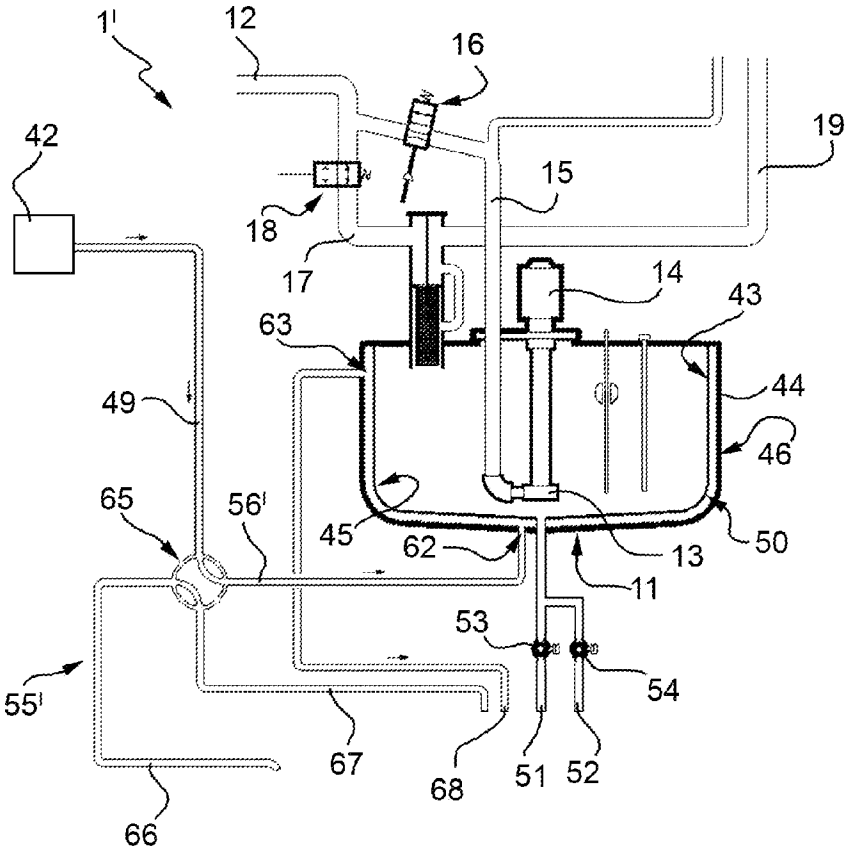

FIGS. 2 and 3 show a different embodiment, indicated as a whole by 1', of a sterilizing unit in accordance with the present invention, and which is described below only insofar as it differs from unit 1, and using the same reference numbers for parts identical or corresponding to those already described.

Unit 1' differs from unit 1 by the coolant, selectively fed into gap 50 of tank 11 at the end of the package production cycle, being defined by the drain-off water from separator 42 of ventilation system 40.

The water from separator 42 of ventilation system 40 is typically at a temperature of roughly 35° C. and therefore capable of effectively cooling the sterilizing agent in tank 11.

In other words, conduit 49 of ventilation system 40 is connectable selectively by a valve 65 to a conduit 56' for filling/draining gap 50 of tank 11. The above parts together define a sterilizing agent cooling system 55' that can be activated selectively at the end of the package production cycle.

The cooling system 55' is a cooling means that is activated selectively by opening the valve 65.

Valve 65 is a four-way, two position type, and interfaces with conduit 49, conduit 56', and two conduits 66, 67, both connected to the drain.

More specifically, valve 65 can be set to a first and second operating position shown in FIGS. 2 and 3 respectively: in the first operating position (FIG. 2) assumed during production, valve 65 connects conduit 49 to conduit 66, and conduit 56' to conduit 67, i.e. drains both ventilation system 40 and cooling system 55'; and, in the second operating position (FIG. 3) assumed at the end of the package production cycle and while ventilation system 40 is running, valve 65 connects conduit 49 to conduit 56', and conduit 66 to conduit 67, i.e. allows the water from conduit 49 of ventilation system 40 to flow through gap 50 of tank 11 to cool the sterilizing agent in it before it is drained.

This solution obviously has the further advantage of cooling the sterilizing agent using water normally used in ventilating sterilizing chamber 3 and the other sterile parts of unit 1, thus eliminating the additional water consumption of the FIG. 1 solution.

Clearly, changes may be made to the sterilizing units 1, 1' and method as described herein without, however, departing from the protective scope defined in the accompanying claims.

The invention claimed is:

1. A unit for sterilizing a web of packaging material for a machine for packaging pourable food products, said unit comprising:

a sterilizing chamber containing a liquid sterilizing agent at a first temperature;

conveying means for feeding said web through said sterilizing chamber before the web is formed into a succession of sealed packages of pourable food products;

a hold tank for said liquid sterilizing agent;

feed means activated selectively to feed said liquid sterilizing agent from said hold tank to said sterilizing chamber;

draining means activated selectively to drain said liquid sterilizing agent from said sterilizing chamber into said hold tank if stoppage of the packaging machine occurs; and cooling means activated selectively to cool said liquid sterilizing agent in said hold tank to a second temperature lower than said first temperature.

2. The unit as claimed in claim 1, wherein said cooling means is configured to cool said sterilizing agent in said tank to said second temperature which is at least 15% lower than said first temperature.

3. The unit as claimed in claim 1, wherein said cooling means is configured to cool said sterilizing agent in said tank to said second temperature which is 60° C. or lower.

4. The unit as claimed in claim 1, wherein said tank is bounded by double walls forming a gap in between; and wherein said cooling means comprise supply means activated selectively to feed coolant into said gap of said tank at the end of the package production cycle.

5. The unit as claimed in claim 4, wherein said supply means is configured to feed water as said coolant.

6. The unit as claimed in claim 4, wherein said supply means comprise water supply means connectable selectively to water mains.

7. The unit as claimed in claim 4, and also comprising a ventilation system activated selectively at the end of the package production cycle to blow a water-washed air jet into at least said sterilizing chamber; and wherein said supply means comprise fluidic connecting means activated selectively to connect a water drain conduit of said ventilation system to said gap of said hold tank.

8. The unit as claimed in claim 7, and comprising separating means for separating the water part from the air-water jet issuing from the packaging machine; and wherein said fluidic connecting means comprise a first conduit connecting said separating means to the drain, a second conduit connecting said gap of said hold tank to the drain, and valve means selectively settable to an operating position connecting said first and said second conduit to each other, so that the water part separated by said separating means flows through said gap of said hold tank before being drained off.

9. A device for sterilizing a web of packaging material to be formed into a pourable food product, the device comprising:

a sterilizing chamber configured to contain a liquid sterilizing agent;

a conveyor configured to move the web of packaging material through the liquid sterilizing agent inside the sterilizing chamber;

a tank including an exterior and a hollow interior configured to contain the liquid sterilizing agent;

a pump configured to discharge the liquid sterilizing agent from the tank;

a supply conduit connected to the pump and configured to supply the liquid sterilizing agent discharged by the pump to the sterilizing chamber;

a first valve positioned along the supply conduit and configured to control an amount of the liquid sterilizing agent flowing through the supply conduit;

a drain conduit connected to the tank and configured to drain the liquid sterilizing agent from the sterilizing chamber to the tank;

a second valve positioned along the drain conduit and configured to control an amount of the liquid sterilizing agent flowing through the drain conduit; and a cooling conduit connected to the exterior of the tank and configured to circulate a liquid coolant over the exterior of the tank to cool the liquid sterilizing agent inside the tank.

10. The device of claim 9, further comprising a third valve positioned along the cooling conduit to control an amount of the liquid coolant flowing through the cooling conduit.

11. The device of claim 10, wherein the cooling valve is configured to open and permit the liquid coolant to flow through the cooling conduit when the conveyor stops moving the web of packaging material.

12. A method of sterilizing a web of packaging material for a machine for packaging pourable food products, said method comprising:

feeding a liquid sterilizing agent at a first temperature into a sterilizing chamber;

feeding said web through said liquid sterilizing chamber before forming it into a succession of sealed packages of pourable food products; and when stoppage of said machine occurs: (i) feeding said liquid sterilizing agent from said sterilizing chamber to an auxiliary tank occur, and when the stoppage occurs at the end of a package production cycle (ii) cooling said liquid sterilizing agent in said auxiliary tank to a second temperature lower than said first temperature.

13. The method as claimed in claim 12, wherein said second temperature is at least 15% lower than said first temperature.

14. The method as claimed in claim 12, wherein said second temperature is 60° C. or lower.

15. The method as claimed in claim 12, wherein said cooling comprises feeding a coolant into a gap formed between double walls defining said auxiliary tank.

16. The method as claimed in claim 15, wherein said coolant is water.

17. The method as claimed in claim 15, wherein said feeding of said coolant comprises connecting said gap of said auxiliary tank to water mains.

18. The method as claimed in claim 15, and comprising, at the end of the package production cycle, ventilating by blowing a jet of air into at least said sterilizing chamber, and then washing the jet with water; said feeding of said coolant comprising separating a water part from an air-water jet issuing from the packaging machine, and feeding said water part into said gap of said auxiliary tank followed by draining off the water part.

* * * * *